United States Patent [19]

Lamb

[11] 4,406,294

[45] Sep. 27, 1983

[54] CIGARETTE FILTER

[75] Inventor: Charles G. Lamb, Anchorage, Ky.

[73] Assignee: Brown & Williamson Tobacco Corporation, Louisville, Ky.

[21] Appl. No.: 349,103

[22] Filed: Feb. 16, 1982

[51] Int. Cl.[3] ..... A24D 3/04

[52] U.S. Cl. ..... 131/336; 131/340

[58] Field of Search ..... 131/336, 340, 198 R, 131/198 A

[56] References Cited

U.S. PATENT DOCUMENTS

| | | | |
|---|---|---|---|
| 3,490,461 | 1/1970 | Osmalov et al. | 131/336 |
| 3,607,512 | 9/1971 | Mathe | 131/340 |
| 3,910,288 | 10/1975 | Hammersmith et al. | 131/336 |
| 4,022,221 | 5/1977 | Berger | 131/340 |
| 4,135,523 | 1/1979 | Luke | 131/340 |
| 4,256,122 | 3/1981 | Johnson | 131/336 |
| 4,338,956 | 7/1982 | Sanford et al. | 131/336 |
| 4,342,322 | 8/1982 | Sanford et al. | 131/336 |
| 4,343,319 | 8/1982 | Cantrell | 131/336 |
| 4,365,641 | 12/1982 | Johnson | 131/336 |

*Primary Examiner*—Vincent Millin

*Attorney, Agent, or Firm*—Charles G. Lamb

[57] ABSTRACT

A filter for a cigarette includes a porous filter rod circumscribed by a porous or air permeable wrapper, and ventilating air grooves embedded in the wrapped filter rod which extend from one end of the filter rod a preselected distance generally longitudinally thereof. The wall of each of the grooves defined by the wrapper is impermeable to air and smoke while at least a portion of the remaining area of the wrapper is air permeable. An air permeable tipping material circumscribes the wrapped filter rod which provides a path for ventilating air flow into the filter rod and a path for air flow into the grooves. Due to the air impermeable wall of the grooves, the air flowing in the grooves is segregated from the air and smoke flowing through the filter rod so that ventilating air is the only substance flowing in the grooves. The air flowing through the tipping material into the filter rod co-mingles with and dilutes the smoke flowing through the filter rod before it reaches the smoker's mouth.

10 Claims, 4 Drawing Figures

CIGARETTE FILTER

BACKGROUND OF THE INVENTION

1. Field of the Invention

This invention relates to a filter for cigarettes. In one aspect it relates to a filter with novel ventilating means. In another respect the invention relates to a filter for a cigarette having flow directing grooves formed therein for directing ventilating air to the mouth end of the filter and concurrently delivering diluted smoke through the filter to the mouth end of the filter.

2. Description of the Prior Art

It is well known in the art to add filters to cigarettes wherein the filters are provided with ventilation means to bring ambient air into the filter to dilute the smoke stream passing therethrough. The dilution of the smoke stream reduces the quantity of smoke particulates as well as the gas phase components which are delivered to the smoker's mouth. A number of means have been proposed and are utilized for introducing ventilating air into the cigarette. For example, the wrapper for the tobacco in a cigarette can be made from a porous material which allows for introduction of air along the entire length of the cigarette where it mixes with the smoke stream passing therethrough thereby diluting the smoke in the stream. Also the cigarette wrapper may be perforated at selected locations along the length of the cigarette which provides ports in the cigarette through which ventilating air enters. Even further, it is known to perforate the wrapper of the filter on the cigarette to allow ventilating air to enter the filter and dilute the smoke stream. There have also been a number of suggestions for incorporating grooves within the filter of a filter cigarette to facilitate the addition of ventilating air into the smoke stream.

For example, U.S. Pat. No. 3,596,663 relates to a tobacco smoke filter provided with a corrugated porous plug wrap surrounding a filter element which is circumscribed by tipping paper having flow-through perforations. The ventilating air enters into the filter element and the grooves through the perforations in the tipping paper and progresses to the smoker's mouth. And, U.S. Pat. No. 4,256,122 teaches a filter for a cigarette which includes grooves extending longitudinally along the outer surface of a filter rod circumscribed by a non-porous plug wrap and the rod and wrap are enclosed with ventilating tipping paper so that in use only ventilating air travels down the grooves and only smoke travels through the filter. Other patents which relate to cigarette filters having grooves circumscribing the filter element for the introduction of ventilating air into the cigarette filter include U.S. Pat. No. 3,577,995; U.S. Pat. No. 3,752,347; U.S. Pat. No. 3,490,461; U.S. Pat. No. 3,788,330; U.S. Pat. No. 3,773,053; U.S. Pat. No. 3,752,165; U.S. Pat. No. 3,638,661; U.S. Pat. No. 3,608,561; U.S. Pat. No. 3,910,288; U.S. Pat. No. 4,256,122 and U.S. Pat. No. 3,910,288.

SUMMARY OF THE INVENTION

The present invention advantageously provides a straightforward arrangement of a filter for a cigarette which in one form achieves essentially normal cigarette pressure drop with low to moderate efficiency filters. The present invention further provides a cigarette filter for lowering tar predominantly by ventilation while also providing filtration of the tobacco smoke. The present invention further provides a filter ventilation system for a cigarette utilizing grooves in the filter plug extending from the ventilating air perforations in the tipping paper to one end, preferably the mouth end of the filter. The present invention also provides a grooved cigarette filter wherein the walls of the groove are air impermeable and the rest of the peripheral surface of the filter is air permeable.

More particularly, the present invention provides a filter for a cigarette comprising a porous filter rod of generally cylindrical configuration, an air permeable wrapper extending longitudinally along said filter rod from one end thereof to the other and circumscribing said filter rod leaving flow through opposing ends of said rod, said wrapper being formed with at least one groove embedded into said filter rod, said at least one groove being open at one end of said filter rod and extending therefrom in a generally longitudinal direction of said filter rod for a distance less than the length of said filter rod, means rendering only the embedded wall of said at least one groove defined by said wrapper material impermeable to air and smoke the other area of said wrapper outside of said at least one groove remaining permeable to air; and tipping material extending longitudinally of and circumscribing said wrapped filter rod, said tipping material being air permeable for permitting ventilating air flow therethrough into said at least one groove so that ventilating air is the only substance flowing in said at least one groove, and also into said filter rod through said permeable area of said wrapper to co-mingle with and dilute the smoke flowing through said filter rod from one end to the other end of said filter rod.

BRIEF DESCRIPTION OF THE DRAWINGS

These and other features of the present invention will become even more clear upon reference to the following description and in conjunction with the accompanying drawing wherein like numbers refer to like parts throughout the views and in which.

DESCRIPTION OF THE PREFERRED EMBODIMENT

Figure 1:
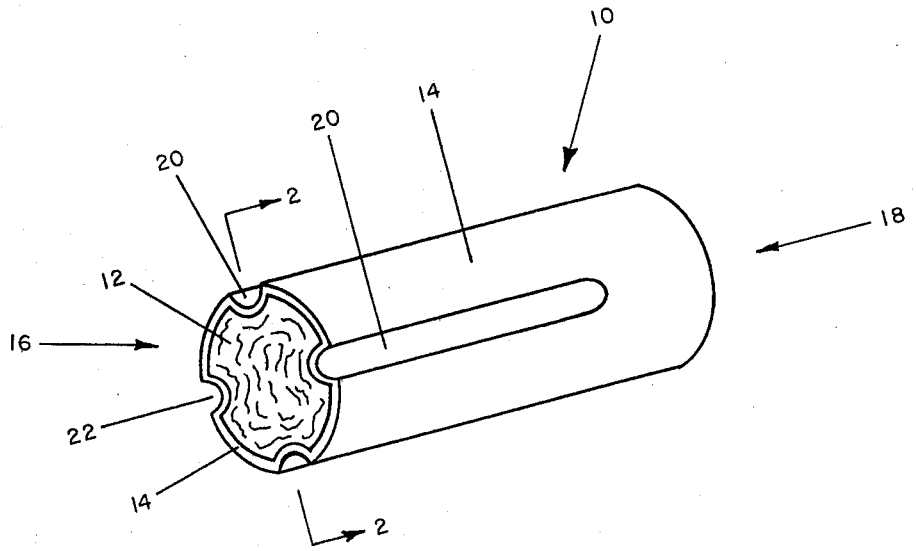
FIG. 1 is a perspective view of a cigarette filter of the present invention with the tipping material removed to more clearly show the various details.
Figure 2:
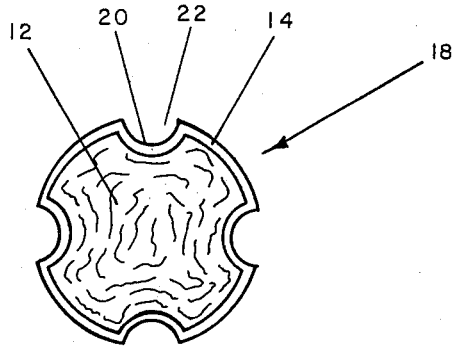
FIG. 2 is an enlarged end view taken in the direction of arrows 2—2 in FIG. 1.

FIGS. 1 and 2 illustrate a cigarette filter, generally denoted as the numeral 10, incorporating the features of the present invention. The cigarette filter 10 is shown as comprising a generally cylindrically shaped filter rod 12 and a circumscribing wrapper 14. The wrapper 14 extends longitudinally along the filter rod 12 from one end 16 of the filter rod to the other end 18 thereof so that the filter rod ends 16 and 18 are in mutual flow through relationship.

The filter rod 12 is fabricated of a porous material such as, for example, fibrous or foamed cellulose acetate, or any other material suitable for filtering cigarette smoke.

Figure 3:
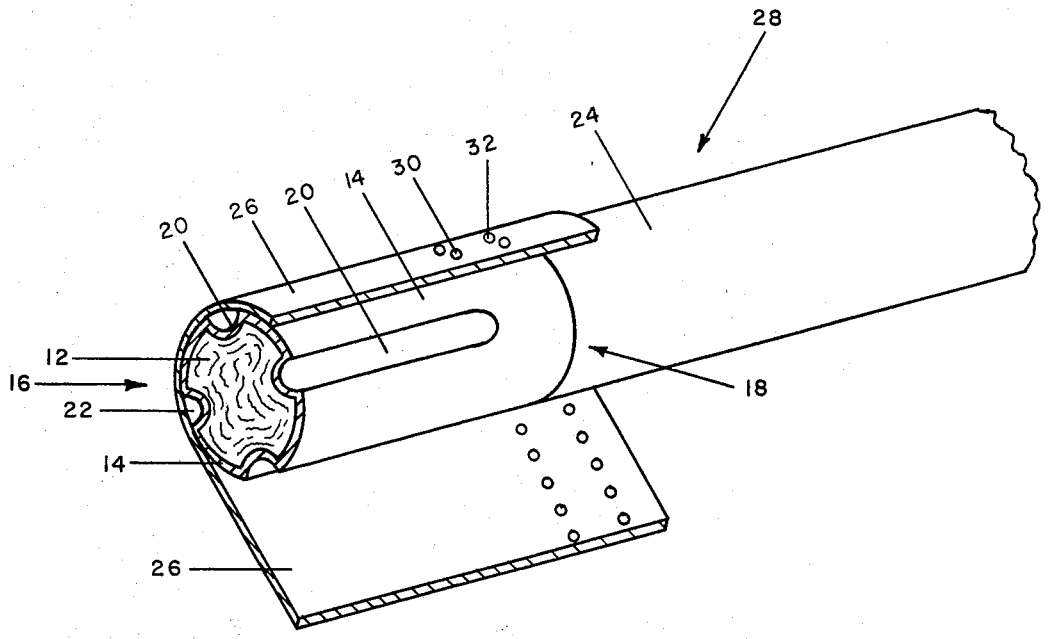
FIG. 3 is a perspective view of a cigarette incorporating the filter of FIG. 1 with the tipping material partially unwrapped and, FIG. 4 is a perspective view of a cigarette incorporating another advantageous filter construction embodying the features of the present invention.

The cigarette filter 10 further comprises a plurality of grooves 20 formed in the wrapper 14 and embedded into the filter rod 12. Each of the grooves 20 is open at one of its ends 22 to the mouth end 16 of the filter rod 12, and extends therefrom in a generally longitudinal direction of the filter rod 12 for a distance less than the length of the filter rod. FIGS. 1, 2 and 3 illustrate four grooves 20 equally spaced from each other about the circumference of the filter rod 12.

In the manufacture of the filter 10, the wrapper 14 can be integrally formed with the filter rod, or can be a separate component. The wrapped filter rod is placed in a mold, or other treating means, for depressing the wrapper 14 at selected locations thus embedding the wrapper into the filter rod and forming the grooves 20. One such method is commonly referred to in the cigarette manufacturing field as heat molding technique.

The embedded portions of the wrapper 14 defining the walls of the groove 20 are impermeable to air, while at least a portion of the other or peripheral areas of the wrapper 14 outside the grooves 20 is air permeable. To this end, the wrapper 14 of the present invention can be fabricated of a porous, air permeable material such as, for example, a fibrous or foamed cellulose acetate. The embedded portions of the wrapper 14 defining the walls of the grooves 20 are treated in a manner to seal the pores to make the walls of the grooves air impermeable. One such treatment is to, for example, apply heat to the wrapper material to heat seal the porous material. Another effective treatment is to coat the embedded portions of the wrapper 14 defining the walls 20 with a chemical such as a water insoluble solution or material, for example ethylcellulose, or a water-soluble material such as, for example, rodium CMC or methylcellulose which seals the pores. Alternatively, the wrapper 14 can be fabricated of an air impermeable material such as, for example, a closed cell cellulose acetate, and the areas of the wrapper 14 outside the grooves 20 can be made air permeable by punching or otherwise forming small perforations through the wrapper.

The wrapped filter rod 12 is attached to a tobacco column 24 with a tipping material 26 which circumscribes the wrapper covered filter rod 12 to form a filtered cigarette 28. The tipping material 26 is air permeable so that ventilating air will flow through it and into the grooves 20 and also into the filter rod 12 through the air permeable areas of the wrapper 14 outside of the grooves 20. To this end, the tipping material 26 is illustrated as being formed with flow-through ventilating air perforations 30 and 32. As illustrated, the perforations 30 communicate with the grooves 20 formed in the filter rod 12 to provide for ventilating air flow into the grooves 20, and the perforations 32 overlay the air permeable areas of the wrapper 14 outside of the grooves 20 to provide for ventilating air flow into the filter rod 12.

As shown, the perforations 30 are formed through the tipping material 26 in a first circumferential array around the wrapped filter rod and communicate with the grooves 20 near their closed ends, i.e., that end of each groove opposed to the open or mouth end 22. The perforations 32 are illustrated as being formed through the tipping material 26 in a second circumferential array around the wrapped filter rod overlaying the air permeable peripheral area of the wrapper 14 upstream, relative to the smoke stream through the filter 10, of the closed ends of the grooves 20. Each of the perforations 30 defines ventilating air flow through area preferrably equal to, or larger than that defined by each of the perforations 32.

As a manufacturing expedient in the formation of the filter 10, it is foreseeable that some of the perforations 30 in the first circumferential array will overlay the wrapper filter rod in the areas between adjacent grooves 20, in which case these perforations 30 will also permit ventilating air to flow into the filter rod 12.

Figure 4:
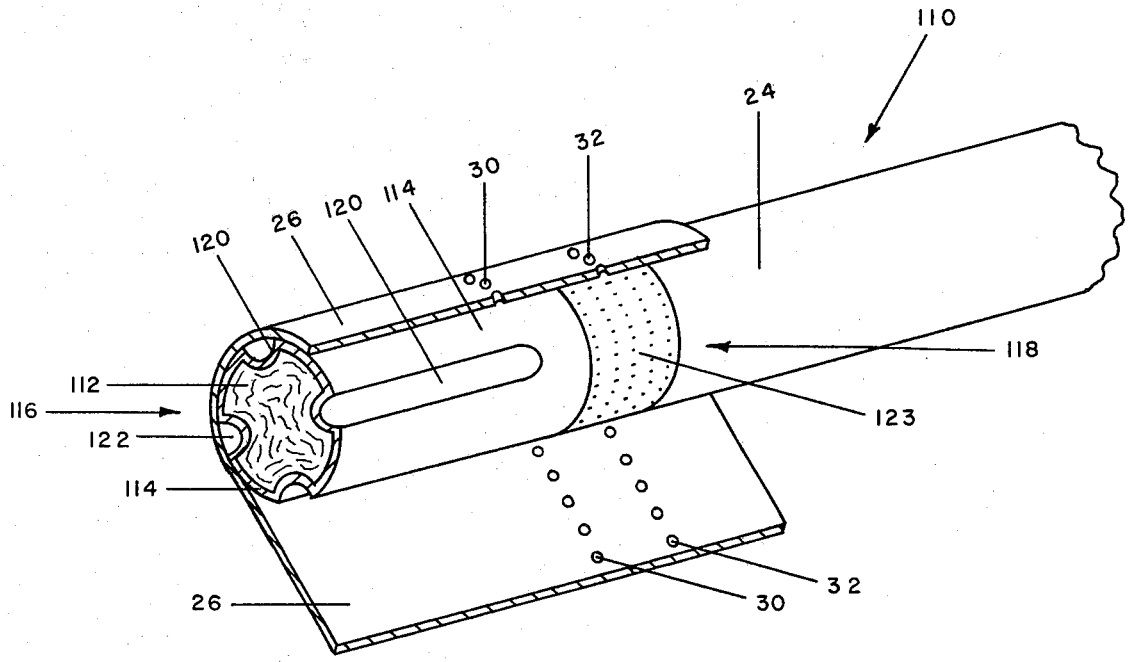

FIG. 4 illustrates another filter construction 110 also embodying the features of the present invention. The cigarette filter 110 is shown as comprising a generally cylindrically shaped filter rod 112 and a circumscribing wrapper 114. The wrapper 114 extends longitudinally along the filter rod 112 from one end 116 of the filter rod 112 to the other end 118 thereof so that the filter rod ends 116 and 118 are in mutual flow through relationship.

As with the cigarette filter 10, the filter rod 112 is fabricated of a porous material, and a plurality of grooves 120 are formed in the wrapper 114 and embedded into the filter rod 112. Each groove 120 is open at one of its ends 122 to the mouth end 116 of the filter rod 112 and extends therefrom in a generally longitudinal direction of the filter rod 112 for a distance less than the length of the filter rod.

In the filter construction 110 not only are the embedded portions of the wrapper 114 defining the walls of the grooves 120 impermeable to air, but the peripheral areas of the wrapper 114 between the grooves 120 are also impermeable to air. However, portion 123 of the wrapper 114 upstream, relative to the direction of the smoke flow through the filter from the filter end 116 to 118, of the closed ends of the grooves 120 is permeable to air. This construction can be accomplished by, for example, fabricating the wrapper 114 of an air impermeable material and forming small apertures in the area of the wrapper upstream of the closed ends of the grooves 120. Alternatively, for example, the wrapper 114 can be fabricated entirely of an air permeable material and only the walls of the grooves and peripheral areas of the wrapper 114 between the grooves treated or coated as described above, to render them air impermeable leaving the portion 123 upstream of the closed ends of the grooves untreated and, therefore, air permeable.

Like the filter construction 10, the filter construction 110 is attached to the tobacco column 24 with the tipping material 26 to form the cigarette 28. The perforations 30 in the tipping material 26 communicate with the grooves 120 to provide for ventilating air flow into the grooves; and the perforations 32 overlay the air permeable portion 123 of the wrapper 114 to provide for ventilating air flow into the filter rod 112.

When a smoker draws on the mouth end 16 of the filter 10 while smoking the cigarette 28, ventilating air is simultaneously drawn through the perforations 30 into the grooves 20 and through the perforations 32 into the filter rod 12 through the air permeable areas of the wrapper 14 outside the adjacent grooves. The ventilating air entering the grooves 20 travels directly to the open end 22 of the groove at the mouth end of the filter rod without mixing with smoke flowing through the filter rod because of the impervious walls of the grooves. The ventilating air entering the filter rod through the perforations 32 mixes with and dilutes the smoke flowing through the filter rod from the tobacco column 24 as it travels to the mouth end of the filter rod.

The foregoing details of the present invention are given primarily for clearness of understanding and no unnecessary limitations should be understood therefrom for modifications will become obvious to one skilled in the art upon reading this disclosure and can be made without departing from the spirit of the invention and scope of the appended claims.

The invention claimed is:

1. A filter for a cigarette comprising:

a porous filter rod of generally cylindrical configuration;

an air permeable wrapper extending longitudinally along said filter rod from one end thereof to the other end and circumscribing said rod leaving flow-through opposed end of said filter rod;

said wrapper being formed with at least one groove embedded into said filter rod, said at least one groove being open at one end of said filter rod and extending therefrom in a generally longitudinally direction of said filter rod for a distance less than the length of said filter rod;

means for rendering the embedded wall of said at least one groove defined by said wrapper material impermeable to air and smoke, at least a portion of said wrapper outside of said at least one groove remaining permeable to air; and tipping material extending longitudinally of and circumscribing said wrapped filter rod, said tipping material being air permeable permitting ventilating air flow therethrough into said at least one groove, and also permitting ventilating air flow therethrough into said filter rod through said permeable portion of said wrapper to co-mingle with and dilute smoke flowing through said filter rod from one end to the other end of said filter rod.

2. The filter of claim 1 wherein said at least one groove comprises a plurality of grooves spaced from each other circumferentially of said filter rod.

3. The filter of claim 1 wherein said tipping material is permeable permitting ventilating air flow into said groove only near the end of said at least one groove opposite the end thereof which is open to the end of said filter rod.

4. The filter of claim 3 wherein said tipping material is air permeable permitting ventilating air flow into said filter rod upstream, relative to the direction of the flow of smoke through said filter rod, of the end of said at least one groove opposite the end thereof which is open to the end of said filter rod.

5. The filter of claim 3 wherein said at least one groove is open at the mouth end of said filter rod for directing ventilating air into the smoker's mouth.

6. The filter of claim 1 wherein said air permeable tipping paper is made permeable by means of perforations formed through said tipping material at selected locations.

7. The filter of claim 6 wherein:

said perforations permitting ventilating air flow through said tipping material into said at least one groove are arranged in a spaced apart circular array about the circumference of said filter rod; and said perforations permitting ventilating air flow through said tipping material into said filter rod are arranged in a spaced apart circular array about the circumference of said filter rod.

8. The filter of claim 6 wherein each of said perforations permitting ventilation air flow into said at least one groove defines a ventilating air flow through area at least as large as the ventilating air flow through area defined by each of said perforations permitting ventilation air flow into said filter rod.

9. The filter of claim 1 wherein said means for rendering the embedded wall of said at least one groove impermeable comprises a heat sealing treatment.

10. The filter of claim 1, wherein said means for rendering the embedded wall of said at least one groove impermeable comprises treating the embedded wall with a porous sealing chemical.

* * * * *